United States Patent [19]

Nermes et al.

[11] Patent Number: 4,465,512

[45] Date of Patent: Aug. 14, 1984

[54] PROCEDURE FOR PRODUCING LEAD BULLION FROM SULPHIDE CONCENTRATE

[75] Inventors: Esko O. Nermes, Turku; Timo T. Talonen, Nakkila, both of Finland

[73] Assignee: Outokumpu Oy, Helsinki, Finland

[21] Appl. No.: 461,456

[22] Filed: Jan. 27, 1983

[30] Foreign Application Priority Data

Feb. 12, 1982 [FI] Finland ..... 820484

[51] Int. Cl.[3] ..... C22B 13/00

[52] U.S. Cl. ..... 75/10 R; 75/26; 75/77; 75/92

[58] Field of Search ..... 75/26, 77, 92

[56] References Cited

U.S. PATENT DOCUMENTS 3,847,595 11/1974 Liang ..... 75/77

FOREIGN PATENT DOCUMENTS 726130 1/1966 Canada ..... 75/77

0053595 6/1982 European Pat. Off. .

*Primary Examiner*—M. J. Andrews

*Attorney, Agent, or Firm*—Brooks, Haidt, Haffner & Delahunty

[57] ABSTRACT

A procedure based on suspension smelting has been developed for producing lead bullion from sulphidic concentrates in which the proportion of iron and of slag-forming substances is low. In the procedure oxygen or oxygen-enriched air is used. The slag containing lead oxide that is formed is in equilibrium with the sulphur-containing but refinable lead bullion. The lead oxide content of the slag may be lowered without increasing the sulphur content of the lead bullion by regulating the temperature, the $FeO+CaO/SiO_2$ ratio and the degree of oxidation. In order that the highest possible amount of the lead contained in the concentrate might be recovered from the settler (3), the quantity of lead compounds in the gas phase is minimized and a hot cyclone is used in the uptake shaft (4) of the smelting furnace.

5 Claims, 4 Drawing Figures

Figure 3:
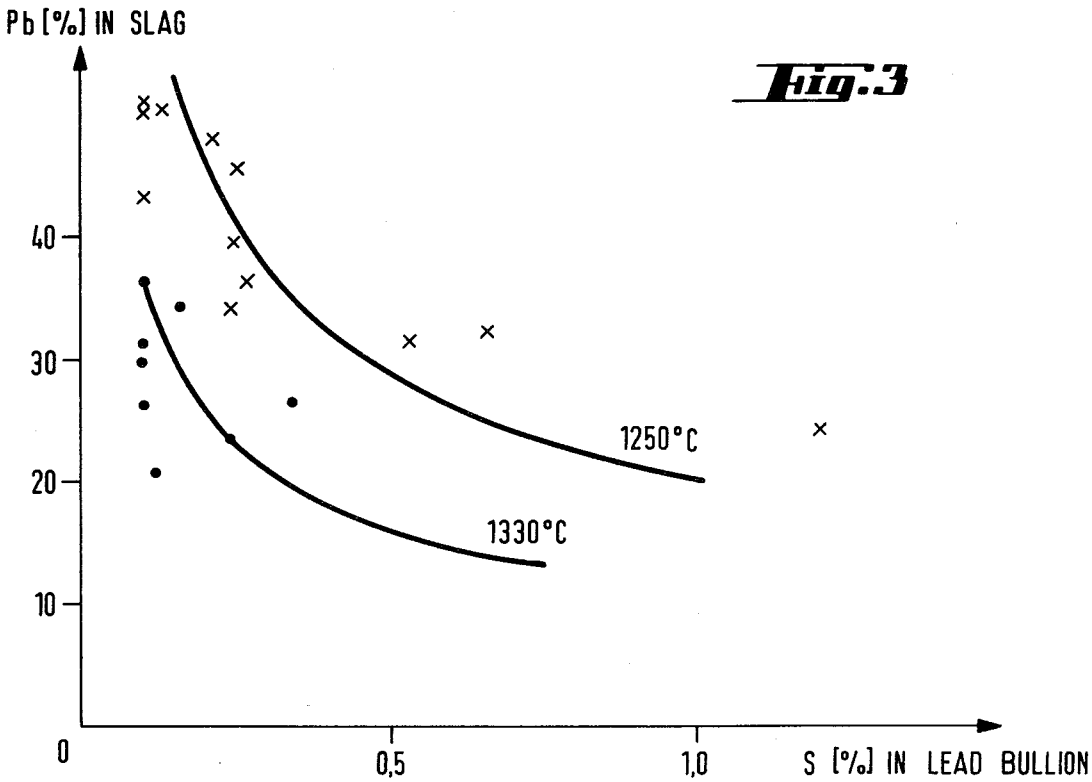

Fig. 1
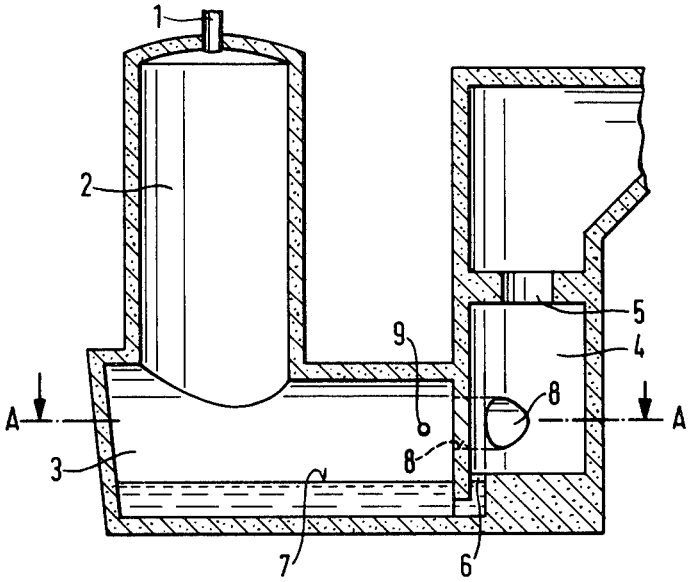
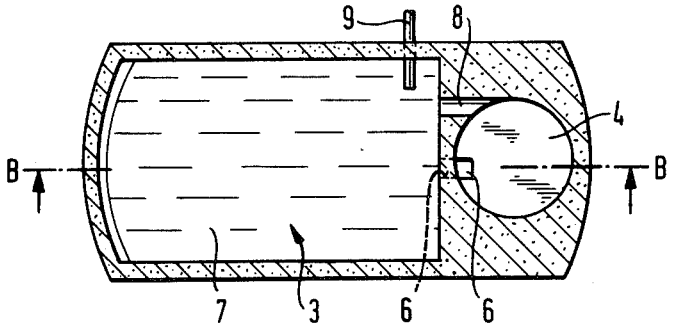
Fig. 2

PROCEDURE FOR PRODUCING LEAD BULLION FROM SULPHIDE CONCENTRATE

The present invention concerns a procedure for producing lead substantially in one stage from sulphidic concentrate by the suspension smelting method.

The conventional lead bullion producing process starting from sulphidic lead concentrate comprises sinter roasting and shaft furnace smelting of the product thus obtained. This method has dominated in the lead producing business for more than 50 years, and even today about 80% of the world's lead bullion production still takes place by this method.

The purpose of the sinter roasting is to separate the sulphur contained in the material and to obtain a porous, oxidic product suited for feed to the shaft furnace. In the shaft furnace, this agglomerate is smelted under reducing conditions together with coke and appropriate fluxes so that the lead and nobler metals become reduced to metal, and zinc and iron remain in oxide form, constituting the slag together with the gangue and added fluxes. In both process stages dilute sulphur-carrying gases and flue dusts are formed.

In spite of many technological improvements, the two-stage process described has several drawbacks. It is unfavourable as regards its thermal economy. In the sintering stage, the roasting reactions are strongly exothermal so that the lead concentrates and the rest of the feed have to be admixed with circulating, cold sinter in order to limit the sintering temperature and to produce a sinter with low S content (about 1%) and suitable Pb content (40–50%). The proportion of circulating material may be up to two-thirds of the feed in order that the difficulties caused by a rich concentrate might be avoided. This may render the ore concentrating useless. In the shaft furnace, heat is required for melting the gangue, whereby cokes are needed both as fuel and as reducing agent.

Besides the sinter roasting/shaft furnace treatment, direct lead producing procedures have been developed since the 1960's. In them, the aim is to smelt the lead concentrate directly to metallic lead and slag according to the formula:

$$PbS + O_2 \rightarrow Pb + SO_2$$

The direct processing method affords remarkable advantages over the sinter roasting procedure: (1) the high circulating load in the sintering process can be avoided; (2) the heat economy of direct processing is more favorable because the heat content of the sulphides in the concentrate may be utilized; (3) the possibility exists in the direct method to use pure oxygen; and (4) the $SO_2$ gases from the process have higher concentration than those of the sintering process (5) better working and environmental hygiene, the polluting sintering phase being eliminated. The direct lead producing methods are mainly based on either suspension or injection smelting.

In injection smelting there serves as smelting unit, as a rule, a converter-type furnace. The concentrate is preferably supplied in pelleted form under the melt surface, as is the oxygen also. It is possible in one alternative to supply the concentrate in pelleted form from the roof of a reverberator type furnace, but the oxygen that must be used is injected into the melt. The lead content of the slag is lowered by injecting powdered coal. In injection smelting, the reactions between oxygen and concentrate take place in the molten phase.

The process developed by Lurgi is partly a direct method: the concentrate is partly roasted, so that the PbS/PbO ratio therein is about 1. This product is smelted in a rotating furnace. One obtains as result, metallic lead bullion containing about 0.4% sulphur, and a slag with 15–30% lead. The lead in the slag is reduced in the same furnace unit by injecting coal into the melt so that the lead content remaining in the slag will be 1–2%.

In the Boliden process, smelting is effected in an electric furnace, into which the partly pre-sintered lead sinter is conducted in the form of suspension, together with air, in between the electrodes. The slag which is produced has lead content about 4%, and the sulphur content of the lead is 3%. Owing to its high sulphur content, the lead is further treated in the converter before refining. In the electric furnace about 40% of the lead volatilizes, and this is recirculated.

In the procedure developed in the 1960's by Outokumpu, the lead concentrate is supplied in suspension with air, into the reaction shaft of a flash smelting furnace. In order to maintain a temperature which is high enough, additional fuel is used in the furnace. The lead thus produced has high sulphur content, but it is not converted; it is instead cooled for segregation of PbS, and this PbS is reacted with the PbO of the slag to obtain metallic lead. Over 30% of the lead volatilizes in the flash furnace.

In the Kivcet method, the lead concentrate is oxidized and smelted in a cyclone far enough to have the greater part of the lead in oxidic form in the slag. The oxidic lead is reduced to metallic state in an electric furnace adjoining the suspension smelting furnace.

In the method of Cominco (U.S. Pat. No. 3,847,595), the concentrate and the oxygen-rich gas suspension are blown through nozzles onto the surface and under the surface of the molten slag. The furnace has no actual reaction shaft where the reactions between lead sulphide and oxygen would take place in the gas phase, but apparently partial oxidation has time to take place in the gas phase even here. The reactions continue under the melt surface so that as result is obtained a slag rich in lead and lead containing little sulphur. The total lead quantity in the concentrate may also be oxidized so far that from the furnace only the slag containing the lead in oxide form is recovered, in which case it must be separately reduced in an electric furnace.

Also WORCRA has done development work on the suspension smelting type lead process. In this method, however, part of the oxygen is supplied through lances into the melt. As a result, lead containing sulphur and slag containing lead are obtained. The metal and slag are made to flow in opposite directions, whereby they are in contact with each other and the lead sulphide in the metal reacts with the lead oxide of the slag, whereby metallic lead is produced.

Outokumpu Oy has recently developed two more new suspension smelting processes. In one method, the entire lead content of the concentrate is fumed. The suspension smelting/fuming can be carried out either reductively or oxidatively. From the reductive smelting/fuming process is obtained a PbS vapor, which is cooled and oxidized, so that metallic lead is produced. Under oxidative conditions PbO vapor is obtained from the process, and this is further treated reductively to obtain a metallic lead melt.

The other suspension smelting method is intended in the first place for very poor concentrates containing slag-forming substances in abundance. In this method the conditions are selected to be such that in the suspension smelting furnace only one melt phase is obtained, which is further treated in the electric furnace. Attention has been paid to the treatment of flue dusts, and the greater part of the lead oxide in the flue dust can be returned in molten state to the furnace by the aid of a slag-forming substance supplied into the uptake shaft of the suspension smelting furnace.

For high grade concentrates containing lead in abundance and with low proportion of iron and of slag-forming substances, a single-step method based on the suspension smelting procedure has now been developed. This method uses substantially pure oxygen or oxygen-enriched gas, and the lead bullion obtained from the suspension smelting furnace is poor in sulphur and therefore refinable without intermediate treatments. The quantity of slag produced is very low, as a result of the minimal quantity of slag-forming substances. In the most favorable case, the amount of lead in the slag is so minimal that the slag that is produced is waste slag.

Thus, the object of the present invention is to provide a procedure for producing lead bullion from sulphidic concentrate in substantially one stage by the suspension smelting process.

Figure 4:
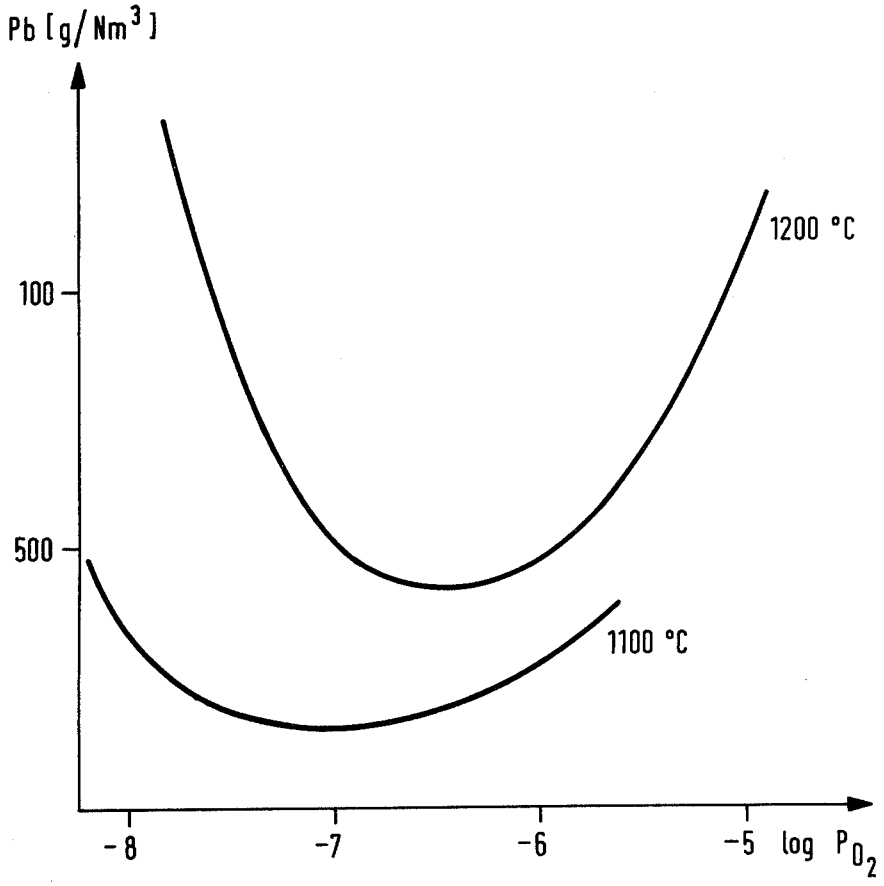

The invention is described more closely below, with reference to the attached drawings, wherein:

FIG. 1 presents the vertical view of a furnace apparatus intended to be used in connection with the procedure of the invention, sectioned along the line B—B in FIG. 2, and FIG. 2 is the section along line A—A in FIG. 1, FIG. 3 presents the relationship between the sulphur content of lead bullion and the lead content of the slag at different temperatures, FIG. 4 presents the relationship between the oxygen pressure of the gas phase and the amount of lead compounds in the gas phase at different temperatures.

The concentrate and the oxygen or oxygen-enriched air are supplied from the roof of a flash smelting furnace, or suspension smelting furnace, through the concentrate burner 1 in the form of suspension into the reaction shaft, or suspension smelting zone, 2. Concentrate and oxygen are supplied in such proportions that an essential part of the lead in the concentrate is obtained in the form of lead bullion.

When the direction of the suspension in the flash smelting furnace is turned through 90°, the main part of the molten/solid material in the suspension separates from the gases and descends to the bottom of the settler 3. The sulphur dioxide-carrying gas separated in the settler 3 from the suspension contains mechanical dust and molten droplets (e.g. lead compounds).

The uptake shaft, or ascending flow zone, 4 consists in actual fact of the molten dust separator, or hot cyclone, from which the dust-free gases depart through the aperture 5. The gas is set in tangential motion, and hereby the melt droplets contained in the gas are flung on the walls of the cyclone and run into the settler through the passage 6. The passage 6 has been so disposed that the melt droplets running downwards meet no gases, because the passage 6 ends under the melt surface 7. The tangential entrance aperture 8 for the gases into the cyclone 4 is located above the melt level and it has been so dimensioned that the gases have the highest possible velocity at moderate pressure losses. In order that a substantial part of the compounds of the vapor present in the gas phase can be separated with the aid of the cyclone, the gases may be cooled before the cyclone at the point 9 with the aid of a cooling agent, e.g. of water. FIG. 4 reveals that for instance at oxygen pressure $10^{-7}$ when the gases are cooled from 1200° to 1100° C., compounds of lead are condensed in excess of 300 g/Nm$^3$. These will remain in the form of small droplets in the gas phase and they can be separated with the aid of the cyclone.

The melt consists of slag and a lead bullion layer thereinunder. The amount of slag is minor and when most advantageous it is discardable. However, in frequent instances the slag must still be treated in the electric furnace in order to recover the metal value. The lead bullion obtained from the settler 3 is fit to be refined.

In the conventional lead producing method in the sintering process, the lead sulphide is subjected to total oxidation according to the formula:

$$Pb+3/2O_2 \rightarrow PbO+SO_2$$

As has been observed before, in direct lead producing procedures only partial oxidation is aimed at:

$$PbS+O_2 \rightarrow Pb+SO_2$$

In the Pb-S-O system, metallic lead is stable at temperatures over 1100° C. when the $SO_2$ partial pressure is less than 1 atm. The lead melt that is formed contains some sulphur and it is in equilibrium with the slag containing PbO upon the lead melt. The quantity of PbO in the slag depends on the composition of the slag and on the oxygen potential of the gas over the slag.

If it is desired by the direct lead producing method to obtain lead bullion acceptable for refining, it is to advantage if the sulphur content of the lead is on the order of 0.1 to 0.5%.

The slag in equilibrium with lead bullion of sulphur content 0.5% contains at 1200° C. about 25% lead in the form of PbO. The amount of lead in the slag can be controlled by expedients of process technology:

1. A change of the temperature in the process causes a change in the lead content of the slag, so that the lead content goes down with increasing temperature, the slag being still in equilibrium with lead bullion having the same sulphur content (FIG. 3).

2. It is possible by changing the composition of the slag, in particular by increasing the $CaO+FeO/SiO_2$ ratio, to lower the amount of lead in the slag. The lead oxide in the slag is bound to silicate ($PbO.SiO_2$). Since lime (CaO, the amount of MgO has also been calculated as CaO) is more strongly basic than PbO, a lime addition to the slag has the effect that the lime is bound to the silicate ($CaO.SiO_2$) and the lead oxide is set free. The suspension coming from the reaction shaft contains still a little lead sulphide, which reduces the liberated lead oxide to metallic state. The $CaO/SiO_2$ ratio is advantageously about 1.

3. The lead quantities in the slag may be influenced by a change of the degree of oxidation. The fitness of the lead bullion for refining is affected not only by the sulphur content but also by the copper content of the lead bullion. At the refining stage, the sulphur in the lead bullion segregates as copper sulphide ($Cu_2S$). If there is copper in the concentrate, the degree of oxidation in the suspension smelting may be regulated to be such that the greater part of the copper goes into the lead bullion. The sulphur content will then also remain higher, but this causes no harm because it can be removed at the refining step. When the degree of oxidation is lower, a smaller part of the lead is oxidized into PbO and goes to the slag, whereby a greater part of the lead may be recovered as lead bullion.

In addition to the ways of controlling the lead content of the slag presented above, the slag in the settler may be reduced with the aid of a powerful reducing agent, for instance powdered coal, and/or with the aid of a reducing gas. The slag may also be treated in an electric furnace for recovery of lead and other non-ferrous metals, such as zinc. The process is economical, since the amount of slag going to treatment in the electric furnace, and particularly the quantity of lead therein, is small and a substantial part of the lead has already been obtained in the form of lead bullion in the settler of the suspension smelting furnace.

When the lead content of the slag in the settler is low, the heat quantity required in the endothermal reducing reaction is small and the reduction may be carried out in the settler. When the lead content of the slag in the settler is higher, it is more profitable to perform the reduction in the electric furnace. Both in the settler of the flash smelting furnace and in the electric furnace, reduction is performed by injecting either into the slag phase or the lead bullion phase. When using the electric furnace, enough reducing agent is injected to prevent the corrosive effect of the slag containing lead oxide on the electrodes. The electric furnace is continuously operating; from the furnace waste slag is tapped, which is granulated, and the lead bullion is tapped e.g. with a siphon.

At the operating temperatures of lead producing processes, the lead compounds, particularly lead sulphide (b.p. 1337°) and lead oxide (b.p. 1537°) have high vapor pressure. The vapor pressure of the lead compounds depends, apart from the temperature, also on the oxygen pressure of the gas phase. According to this method, endeavours are to regulate the oxygen pressure in the flash smelting furnace to be in the range where the quantity of gaseous lead compounds is at its minimum within the temperature range from 1100° to 1300° C. According to FIG. 4, this implies that the oxygen pressure is regulated to be within $10^{-5}$ to $10^{-7}$ in the gas phase. In that case the least possible part of the lead in the concentrate will escape along with the flue dusts into the uptake shaft.

Endeavours have also been made to reduce the flue dust losses in the process by using a molten dust separator in the uptake shaft of the flash smelting furnace. As it passes through the molten dust separator, or hot cyclone, the gas is set in tangential motion. Hereby the dust present in the gas in molten state is flung to the walls of the cyclone, where it becomes adherent and runs down along the walls. The exhaust gas passing through the hot cyclone, and the dusts, are conducted to a boiler where the gas is cooled. The dusts are removed from the boiler and from the electric filter following after the boiler, below, and pneumatically transported to a dust bin, whence the dust is fed into the reaction shaft of the flash smelting furnace.

The circulating load constituted by the flue dusts which have to be circulated according to the procedure is low, and the compounds in them (e.g. sulphates) have no significant influence on the thermal balance and oxidizing conditions of the process. It has been found in test runs that were carried out that by the procedure of the invention nearly the whole lead content of the concentrate (more than 90%) is recovered from the settler of the flash smelting furnace.

The invention shall furthermore be illustrated by means of an example.

EXAMPLE 1000 kg concentrate were fed into a flash smelting furnace, the concentrate having 72.7% Pb content. 107 $Nm^3$ of oxygen and 28.5 kg of flux substances per ton of concentrate were supplied. The flue dusts were in circulation. 694 kg of lead bullion were tapped from the flash smelting furnace. 182 kg slag were produced, with 25.6% Pb. The slag temperature was 1250° C. The sulphur content of the lead bullion from the electric furnace was less than 0.1% and the lead content of the slag was 2.8%. Of the lead contained in the concentrate, 93.5% could be recovered in the flash smelting furnace for refining, and the combined yield of flash smelting furnace and electric furnace was 97.2%. The losses consisted of the lead going to the waste slag and the lead volatilized in the electric furnace.

We claim:

1. Procedure for producing lead bullion in substantially one stage by the suspension smelting procedure from lead sulphide concentrate containing iron, comprising the steps of:

(a) supplying finely dispersed lead sulphide concentrate and oxygen or oxygen-enriched air and lime and silicate flux into an upper part of a suspension smelting zone for forming a suspension and oxidizing the lead sulphide to lead bullion with a sulphur content of 0.1 to 0.5% by weight, (b) controlling lead content of the slag forming in a settler by controlling the temperature, the $FeO+CaO/SiO_2$ proportion in the slag and the degree of oxidation, jointly or separately, and/or reducing PbO in the slag by adding powdered coal, (c) regulating oxygen pressure of the gas phase to be in the range where the lead content of the gas is at its minimum, (d) in an ascending flow zone, subjecting gases containing flue dusts and molten droplets containing lead compounds to cyclone separation in order to return flue dusts and molten lead to said settler so that the quantity of lead bullion obtained from the settler will be a substantial part of the lead quantity contained in the concentrate.

2. Procedure according to claim 1, characterized in that the lead oxide in the slag is reduced in the settler by injecting powdered coal either into the slag or into the lead bullion phase.

3. Procedure according to claim 1, characterized in that the reduction of the lead oxide in the slag is carried out in an electric furnace by injecting powdered coal either into the slag or into the lead bullion phase.

4. Procedure according to claim 1, characterized in that the oxygen pressure of the gas phase is adjusted to be in the range from $10^{-5}$ to $10^{-7}$ when the temperature is 1100° to 1300° C.

5. Procedure according to any one of the preceding claims, characterized in that the quantity of lead obtained from the settler is about 90% by weight of the lead quantity contained in the concentrate.

* * * * *

UNITED STATES PATENT AND TRADEMARK OFFICE

CERTIFICATE OF CORRECTION

PATENT NO. : 4,465,512

DATED : August 14, 1984

INVENTOR(S) : Esko O. Nermes; Timo T. Talonen

It is certified that error appears in the above-identified patent and that said Letters Patent is hereby corrected as shown below:

Column 1, line 38:

"gangue, whereby" should read --gangue, and so--.

Signed and Sealed this

First Day of January 1985

[SEAL]

*Attest:*

GERALD J. MOSSINGHOFF

*Attesting Officer*

*Commissioner of Patents and Trademarks*